US005158120A

United States Patent [19]

Kaufmann et al.

[11] Patent Number: 5,158,120

[45] Date of Patent: Oct. 27, 1992

[54] CLEARING A WEFT YARN BREAK IN A LOOM

[75] Inventors: Josef Kaufmann, Elsau; Eric Mäder, Hettlingen, both of Switzerland

[73] Assignee: Sulzer Brothers Limited, Winterthur, Switzerland

[21] Appl. No.: 702,267

[22] Filed: May 17, 1991

[30] Foreign Application Priority Data

May 21, 1990 [CH] Switzerland ..... 01721/90

[51] Int. Cl.[5] ..... C03D 49/00; C03D 47/30

[52] U.S. Cl. ..... 139/450; 139/116.2; 139/194

[58] Field of Search ..... 139/450, 116.2, 194, 139/452, 453

[56] References Cited

U.S. PATENT DOCUMENTS

| | | | |
|---|---|---|---|
| 4,664,157 | 5/1987 | Shin | 139/116.2 |
| 4,729,411 | 3/1988 | Ellenberger et al. | 139/116.2 |
| 4,958,662 | 9/1990 | Takegawa | 139/116.2 |

FOREIGN PATENT DOCUMENTS

| | | |
|---|---|---|
| 0161376 | 11/1985 | European Pat. Off. . |
| 0171057 | 2/1986 | European Pat. Off. . |
| 0309012 | 3/1989 | European Pat. Off. . |
| 0332257 | 9/1989 | European Pat. Off. . |
| 0365472 | 4/1990 | European Pat. Off. . |
| 2248353 | 5/1975 | France . |
| 602826 | 6/1988 | Netherlands . |

*Primary Examiner*—Andrew M. Falik
*Attorney, Agent, or Firm*—Kenyon & Kenyon

[57] ABSTRACT

A pivotally mounted yarn guiding member is disposed between a weft yarn injector and a shed of warp yarns to effect drawing in of a fresh weft yarn as well as extraction of a broken weft yarn from the loom. The yarn guiding member is pivotable into a bottom position after receiving a fresh yarn end to deflect the yarn about a centering vane so that a shears may cut the yarn to form a fresh yarn tip for subsequent picking. The yarn guiding member is pivotable between a central position and a top position after receiving a loop of a broken weft yarn so as to extract the broken end of the yarn from within the shed or from the point upstream of the injector nozzle. An extraction duct is also provided on the exit side of the shed to extract the broken piece of the weft yarn via a reciprocating motion and suction. A hooked needle is also provided to effect formation of a loop of yarn for extraction by the yarn guiding member when a brake occurs upstream of the injector nozzle.

20 Claims, 3 Drawing Sheets

CLEARING A WEFT YARN BREAK IN A LOOM

This invention relates to a method and device for clearing a weft yarn break in a loom and particularly in a projectile loom.

As is known, various types of looms have been provided with various types of picking mechanisms for the picking of a weft yarn through a shed of warp yarns. However, in the event of a weft yarn breakage, the loom must be stopped, the broken weft yarn removed, the picking mechanism prepared with fresh yarn and, finally, the loom restarted. In order to reduce the loom downtime due to weft yarn breakages, various automated mechanisms have been utilized in order to render manual intervention by a loom operative unnecessary. Such mechanisms for automatically removing yarn residues in the event of a weft yarn breakage are known, for example, from German OS 23 52 730.

Mechanisms have also been known for drawing a weft yarn into a loom in which the yarn is supplied from a bobbin to picking element. For example, European Patent Application 0365472 describes a mechanism which has been developed for an air jet loom but may be suitably adapted for use in a projectile loom in order to supply a weft yarn.

Other devices for removing a broken weft yarn from within a shed have also been described in French Patent 2,248,353; European Patent Application 0332257 and Dutch Patent Application 8602826. However, such devices have been rather cumbersome and are time consuming in operation while being limited to removing broken yarn ends from a weft yarn which has broken only within a shed.

Accordingly, it is an object of the invention to provide for an automatic clearance of weft yarn breakage in a loom which requires little loom downtime.

It is another object of the invention to combine the steps of clearing a weft yarn residue from a loom and the drawing in of a fresh yarn in a rational manner that individual components operate together in various steps or stages.

It is another object of the invention to be able to remove a weft yarn breakage from a loom and to deliver a fresh yarn to the loom in a relatively simple manner and in a relatively short period of time.

Briefly, the invention provides a method of clearing a weft yarn break in a loom having means defining a shed of warp yarns. In accordance With the method, a pivotally mounted hollow yarn guiding member is positioned adjacent the shed and in alignment with a weft yarn which is broken within the shed. In addition, a suction force is effected in the yarn guiding member in order to draw a loop of the aligned weft yarn into the yarn guiding member while the yarn guiding member is thereafter pivoted in a reciprocating manner transversely relative to the shed in order to draw the broken weft yarn from the shed while maintaining the suction force in the yarn guiding member.

The reciprocating motion of the yarn guiding member serves to pull the broken weft yarn from the shed. In this regard, the pivoting of the yarn guiding member may effect a partial withdrawal of the weft yarn while the suction force completes withdrawal of the weft yarn from the shed. While the yarn guiding member is pivoting towards the position closest to the shed, the weft yarn may be held within the yarn guiding member so as to resist being pulled out of the member in a direction towards the shed.

In accordance with the method, the tension in a weft yarn in the shed may be monitored in order to record the occurrence of a weft yarn break and to stop the movement of a reed in the shed for beating-up of the weft yarn in response to detection of the yarn break. On the other hand, should the broken weft yarn have been beaten-up, the yarn may be loosened after breakage and prior to drawing of the weft yarn into the yarn guiding member.

The invention also provides a weft yarn clearing device which includes a pneumatic injector nozzle for conveying a weft yarn therethrough towards a shed of warp yarns and a pivotally mounted hollow yarn guiding member, as above, which is pivotable between a first position aligned with the nozzle in order to receive a weft yarn therefrom and a second position in order to draw a broken weft yarn from the shed. More particularly, the yarn guiding member has an aperture for passage of a weft yarn therethrough and a deflecting element disposed adjacent the aperture for deflecting a weft yarn passing thereover during movement of the yarn guiding member from the first position to the second position.

Once the yarn guiding member has effected a removal of a broken weft yarn from within the shed, the yarn guiding member can again be aligned with the pneumatic injector nozzle so as to receive a fresh weft yarn for picking into the shed. In this latter respect, the device is further provided with a pivotally mounted centering vane between the nozzle and the yarn guiding member for pivoting between a position aligned with the nozzle in order to guide a weft yarn extending from the nozzle to the shed and a second position out of alignment with the nozzle. In addition, a shears is provided for cutting a weft yarn between the injector nozzle and the centering vane with the yarn guiding member in a lowered bottom position in order to form a yarn tip for subsequent picking into the shed.

The yarn guiding member is thus pivotable between a central position aligned with the nozzle in order to receive a weft yarn therefrom, a bottom position to deflect a weft yarn extending from the nozzle about the centering vane with the vane aligned with the nozzle and a top position in order to draw a broken weft yarn from the shed. That is to say, with the nozzle, centering vane and yarn guiding member in alignment, a yarn can be blown into the yarn guiding member from the injector nozzle. Thereafter, the yarn guiding member is lowered into the bottom position so as to deflect the yarn about the centering vane so that the shears may cut the weft yarn and form a fresh yarn tip. The severed portion of the yarn can then be drawn off through the yarn guiding member. In addition, a suitable clamp may be reciprocably mounted between the nozzle and the shears for gripping the weft yarn, for example for delivery to a projectile for picking through the shed of the loom.

Should a Weft yarn become broken within the shed, a loop of yarn between the nozzle and the centering vane can be delivered into the yarn guiding member and the yarn guiding member thereafter reciprocated up and down between the central position and the top position thereof so as to withdraw the broken weft yarn from the shed.

Should the weft yarn be broken at some point upstream of the injector nozzle, use may be made of a reciprocably mounted hook needle between the nozzle and the centering vane for selective disposition over the weft yarn so as to permit blowing of a loop of weft yarn between the nozzle and needle into the yarn guiding member. The yarn can thus be removed from the injector nozzle. At the same time, a fresh weft yarn can be blown into the yarn guiding member from the injector nozzle.

The device is also provided with a pivotally mounted hollow extraction duct at the exit side of the shed for drawing a broken weft yarn into the duct. In order to enhance this effect, a blowing nozzle can be positioned adjacent the extraction duct for blowing a broken weft yarn into the duct.

Still further, a blowing nozzle may be provided for blowing a weft yarn from a projectile in a yarn brake on the exit side of the shed towards the extraction duct.

These and other objects and advantages of the invention will become more apparent from the following detailed description taken in conjunction with the accompanying drawings wherein:

FIG. 1 schematically illustrates various components of a loom in combination with various components of a device for clearing a weft yarn break from the loom in accordance with the invention;

Figure 1:
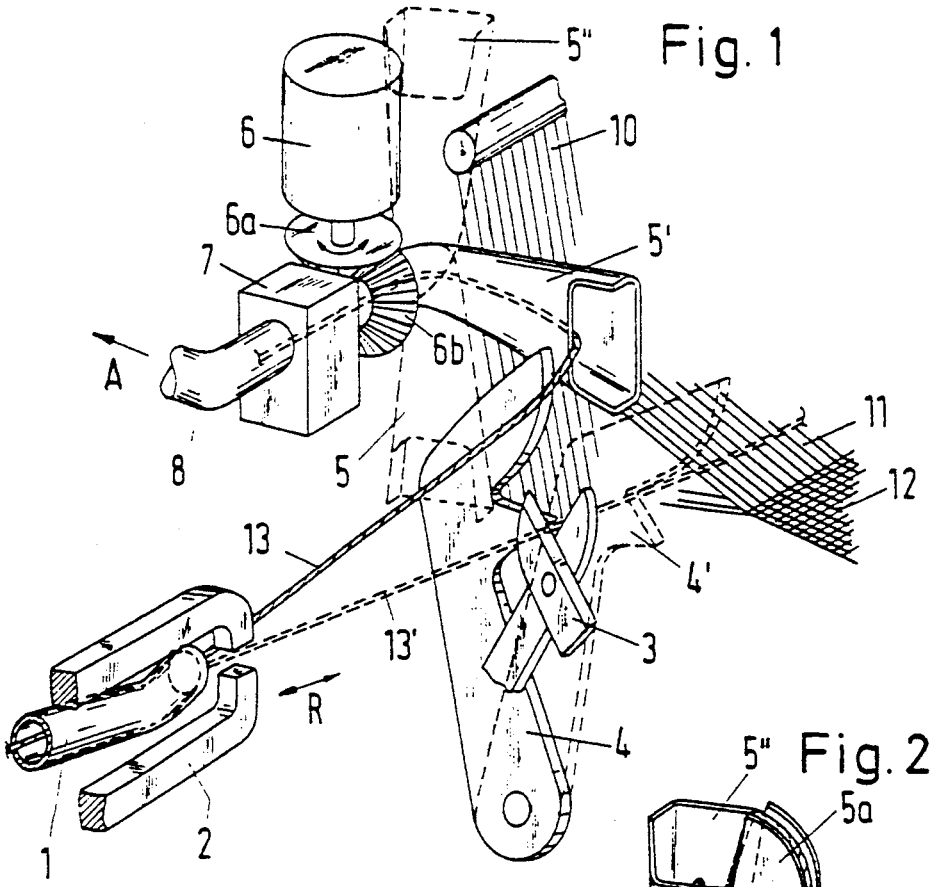

Referring to FIG. 1, the loom is constructed in conventional fashion with a weft accumulator (not shown) and a picking mechanism which has various operating elements, such as, a projectile lift for supplying a projectile, a projectile opener, a giver, a giver opener, a striking mechanism, a yarn tensioner, a yarn brake and a weft yarn monitor, none of which are shown. The weft yarn is guided in a channel combined from tubular members and interrupted at places for various operating elements. In order that the weft yarn may be deflected transversely to the direction of movement in some sections, the tubular members associated with such sections are slotted lengthwise.

As is shown in FIG. 1, the picking mechanism also includes an injector nozzle 1, a reciprocably mounted clamp 2 of a yarn giver, a shears 3, a centering vane 4 and a pivotably mounted hollow guiding member 5 of funnel shape.

The injector nozzle 1 is of pneumatic type for conveying a weft yarn 13 therethrough towards a shed of warp yarns 11.

The clamp 2 is disposed between the nozzle 1 and the centering vane 4 so as to reciprocate therebetween in the direction indicated by the double arrow R.

The shears 3 is positioned adjacent to the centering vane 4 so as to sever a weft yarn thereat. The shears 3 is also movable into a retracted position (not shown) so as to avoid interfering with the picking of the weft yarn.

The centering vane 4 is pivotally mounted for pivoting between a position 4' (shown in dotted line) aligned with the nozzle 1 in order to guide the weft yarn extending from the nozzle 1 to the shed and and a second position (shown in solid line) out of alignment with the nozzle 1.

The hollow yarn guiding member 5 is movable between a central position 5' (shown in solid lines) aligned with the nozzle 1 in order to receive a weft yarn 13 therefrom, a bottom position 5 (shown in dotted lines) to deflect a weft yarn extending from the nozzle 1 about the vane 4 with the vane 4 in the aligned position shown in dotted line and a top position 5'' in order to draw a broken weft yarn from the shed as described below.

A pivoting drive 6 is provided for moving the yarn guiding member 5 between the various positions thereof, via bevel gears 6*a*, 6*b*. In addition, a box 7 symbolizing a yarn brake and/or a yarn monitor and/or an injector nozzle is provided in communication with the yarn guiding member 5 to receive weft yarn therefrom. In addition, a delivery tube or extraction line 8 is in communication with the box 7 and, thus, the yarn guiding member 5 for removing yarn under a suction force or under a blowing force as indicated by the arrow A.

As shown in FIG. 1, the loom is provided with a reed 10 for beating up the picked weft yarn 13 into the shed defined by the warp yarns 11 into a cloth 12 as is known.

When a weft yarn 13 is being drawn in, the typical yarn is blown from the nozzle 1 into an aperture of the funnel-shaped yarn guiding element 5 when in the central position illustrated in FIG. 1. This yarn end is conveyed further into the yarn guiding element by suction. Thereafter, the center vane 4 engages the weft yarn and moves the yarn into a position in which the yarn can be engaged by the clamp 2. The shears 3 is then actuated to cut the correct length of yarn while the surplus yarn end is extracted via the yarn guiding member 5 and extraction tube 8.

The situation which is shown in FIG. 1 and in which the vane 4 is in its rear position and the yarn guiding member 5' is in its central position, is the situation associated with the drawing in of a new weft yarn 13. Subsequent to this situation, the vane 4 pivots forwards and the yarn guiding member 5 pivots downwards into a bottom position, the weft yarn 13 sliding into the throat of the vane 4. The clamp 2 engages the weft yarn 13 at the shears 3 and the weft yarn can then be severed, the severed piece of yarn being extracted through the tube 8. In the rear position shown, the clamp 2 transfers the yarn tip to the projectile (not shown). Before picking, the shears 3 and the vane 4' pivot out of the flight path. The picked weft yarn 13, is shown in chain lines. The injector 1 has a curved exit part to ensure that during drawing in, the yarn tip is blown towards the aperture of the yarn guiding member 5'. A construction in which the exit is straight is also feasible.

Figure 2:
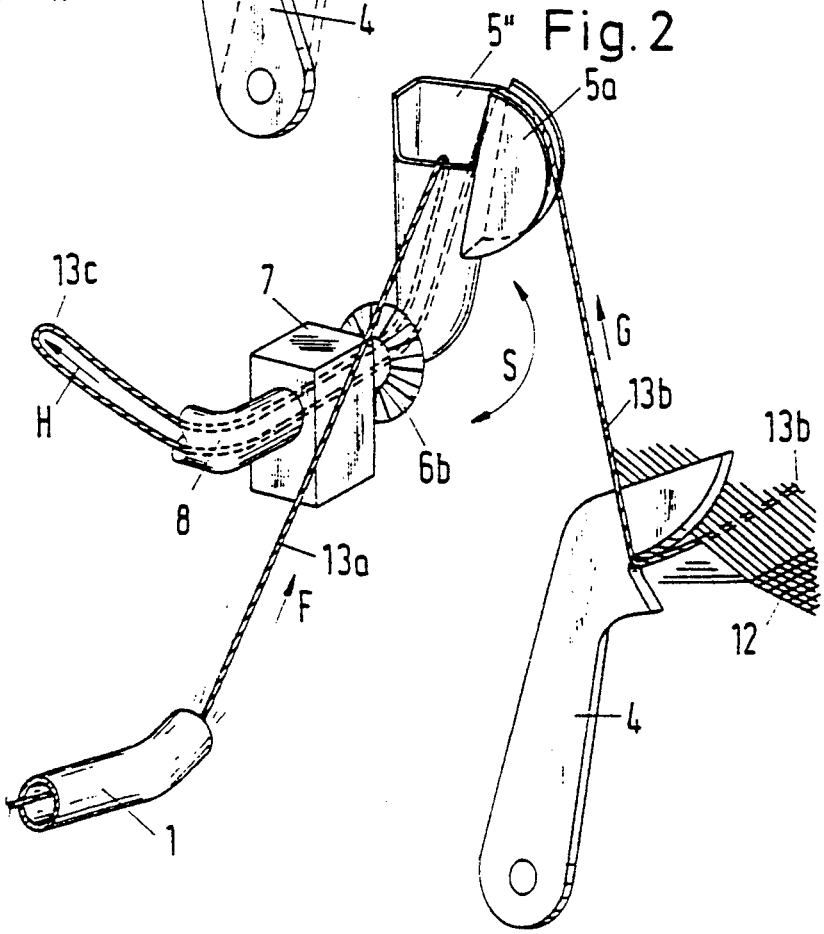
FIG. 2 illustrates the position of the yarn guiding member in a top position during withdrawal of a broken weft yarn from within a shed in accordance with the invention.

FIG. 2 shows the operating elements at the shed entry but the clamp 2, shears 3 and reed 10 of FIG. 1 are not shown. The yarn guiding member 5 which is in its top position in FIG. 2, also has a deflecting element 5*a* which is in the shape of a circle segment and over whose edge the weft yarn is guided. During the downwards pivoting movement indicated by a double arrow S, the distances between the aperture of the yarn guiding member 5 and the injector nozzle 1 or centering vane 4, decrease and so the two yarn pieces 13*a*, 13*b* can be extracted in the form of a loop 13*c*, as indicated by an arrow H. When the yarn-guiding member 5 pivots up again, the weft yarn which has broken in the shed is drawn further out of the same, as indicated by an arrow G. Simultaneously, yarn issues from the injector nozzle 1, as indicated by an arrow F. During this pivoting-up of the member 5, the yarn brake 7 is, with advantage, operated to prevent any drawing back of the loop 13*c* in the direction opposite to the direction indicated by the arrow H. Repeated reciprocating pivoting of the member 5 can draw the broken weft yarn 13*b* completely out of the shed, so that the end result is a situation corresponding to that shown in FIG. 1 for the drawing in of a new weft yarn.

If the warp and weft yarns are not very rough, the member 5 need make only a few pivoting movements to effect a partial withdrawal of the weft yarn and further removal of the broken weft yarn from the shed can be effected solely by the suction. The segmental deflecting element 5*a* on the side of the member 5 is effective to deflect the yarn 13*b* , and thus increase the length of yarn drawn out per pivoting movement and, therefore, reduce the number of pivoting movements required. Advantageously, complete removal of broken weft yarn from the shed is monitored by a sensor disposed, for example, in the box 7.

The loom needs to be stopped rapidly in the event of a weft yarn breakage so that the reed 10 ceases a beating up movement. A rapid stoppage calls for the use of a sensor which records the breakage at or immediately after rupture. This requirement can be met by means of a sensor which monitors yarn tension during picking. If the loom cannot be stopped in good time, the beaten up weft yarn must first be loosened by an additional device (see e.g. DE-OS 2 352 730), otherwise when the weft yarn is being drawn out of the shed, a piece of yarn may be lost therein because of a second breakage.

To draw in a new weft yarn, the yarn guiding member 5 needs to be pivotable only between the bottom and central positions. However, for weft yarn clearance, the top position must be reachable, i.e. the pivoting movement must be possible through an angle of, if at all possible, 180°. A pivoting movement through an even greater angle enables a correspondingly longer piece of yarn to be drawn out of the shed per stroke. Thus, the top and bottom positions of the yarn guiding member 5 are diametrically opposite each other.

In the event of a yarn breakage between a bobbin and the accumulator, the picked weft yarn can be woven in but the yarn in the accumulator must be removed before a new weft yarn can be drawn in. This can be effected by means of a hooked needle, as will be described in greater detail with reference to FIGS. 3 and 4. In contrast to what is shown in FIGS. 3 and 4, the hook opening can face downwards.

Figure 3:
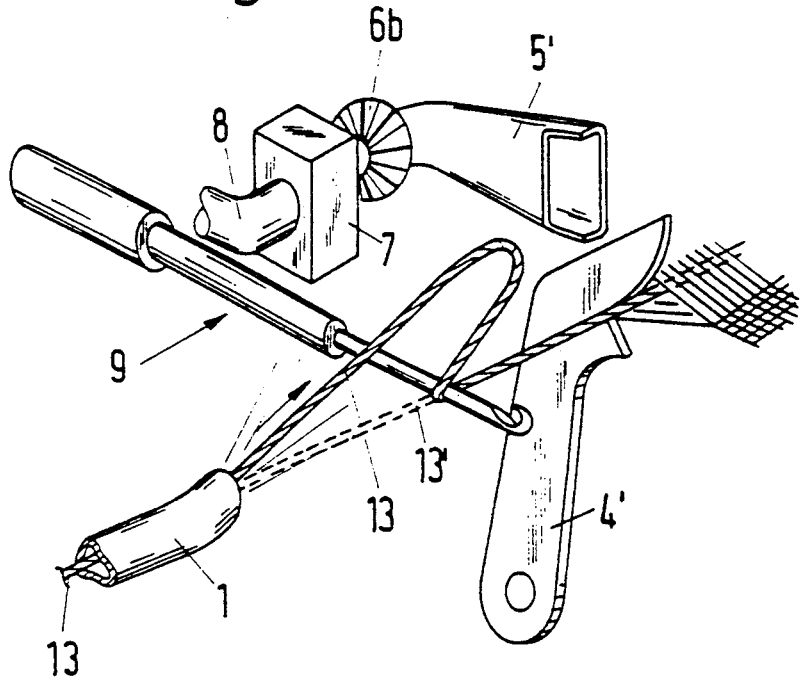
FIG. 3 illustrates the positions of various components of the weft yarn clearing device for clearing a weft yarn which has broken upstream of an injector nozzle in accordance with the invention.
Figure 4:
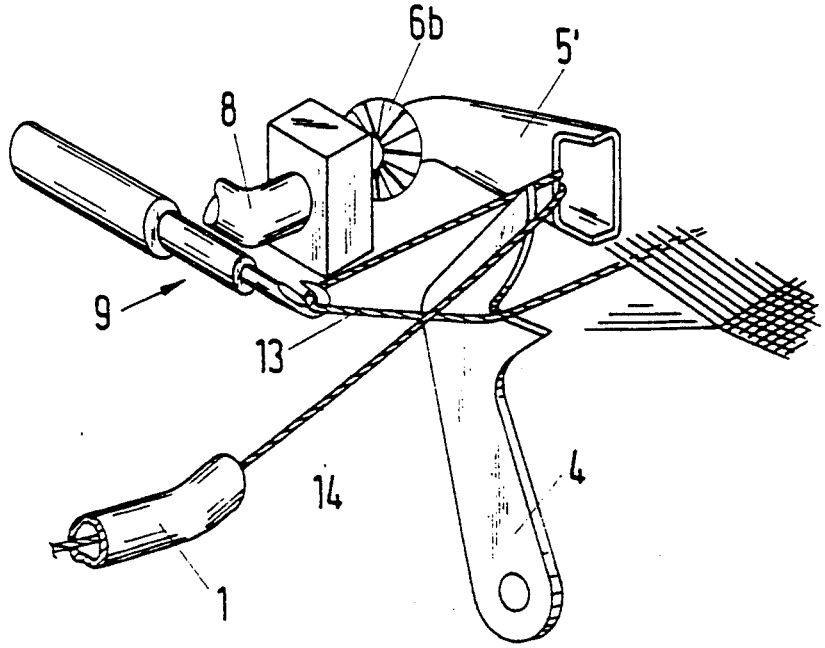
FIG. 4 illustrates a view similar to FIG. 3 after clearing of a broken weft yarn from upstream of an injection nozzle and during injection of a fresh weft yarn.

Referring to FIG. 3, the hooked needle 9 can be so introduced, for example, telescopically, in the zone between the nozzle 1 and the vane 4' as to be disposed above the tensioned weft yarn 13'. After the needle 9 has been slid into position, the injector nozzle 1 draws further yarn 13 from the accumulator. A yarn loop forms above the needle 9, is deflected towards the entry aperture of the yarn guiding member 5' (central position) and can be extracted there. The yarn accumulator can then be emptied by extraction by way of the member 5'.

After the emptying, the needle 9 moves back and the vane 4' moves into its rear position as shown in FIG. 3. When the needle 9 moves back, the yarn 13 remains hanging in the hook. A new weft yarn 14 can then be injected via the nozzle 1 and drawn in together with the yarn 13 into the throat of the vane 4. This drawing in of the weft yarn 14 proceeds in the manner hereinbefore described, the vane 4 pivoting into the forwards position and the member 5' pivoting into the bottom position After the clamp 2 (not shown) has engaged the weft yarn 14, the two yarns 13, 14 are severed together by the shears 3, shown in FIG. 1 but not in FIGS. 3 and 4, and the two yarn remainders are extracted in the member 5'.

Figure 5:
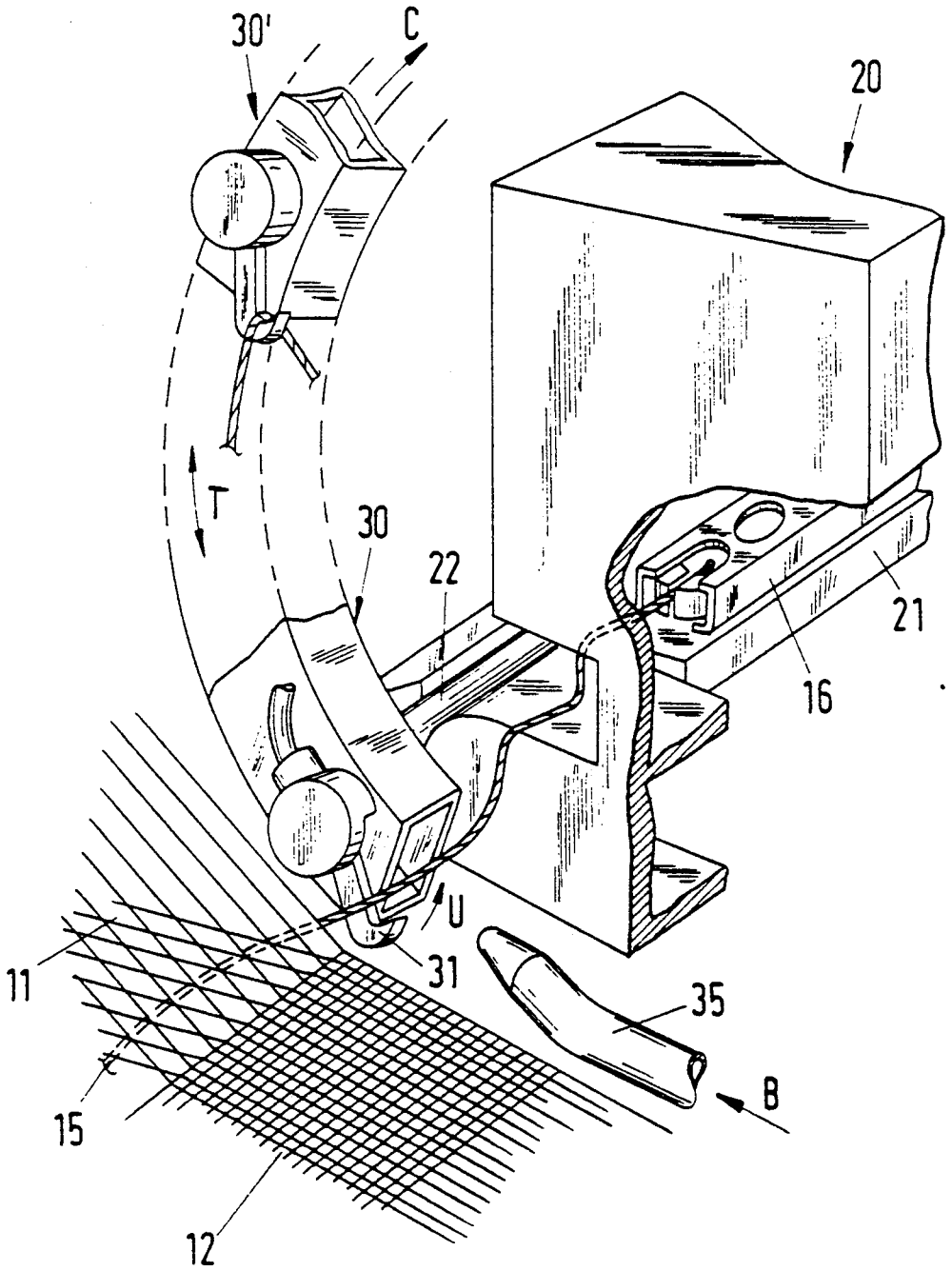
FIG. 5 illustrates an extraction duct of the weft yarn clearing device at an exit side of a shed in accordance with the invention.

Referring to FIG. 5, wherein like reference characters indicate like parts as above, the loom is also provided with a catching brake 20 on the exit side of the shed for catching a projectile 16. In this respect, a bottom brake shoe 21 and a projectile ejection channel 22 of the brake 20 are illustrated. Other components such as a return slide, projectile opener, ejector and top brake shoes are not shown. During operation, the projectile 16 is received in the brake 20 and recoils. Thus, because of the recoil, the yarn in the shed must be drawn back correspondingly in order to keep the yarn in a stretched condition. However, after removal of the yarn 13 from the weft accumulator (not shown), this operation cannot be performed by the yarn tensioner (not shown) of the picking mechanism. Instead, the hooked needle 9 (see FIG. 3) can take over this tensioning function in addition to the function described above. To this end, the corresponding return movement of the needle 9 can be produced, for example, by means of a pneumatic actuating cylinder.

In the event of a weft yarn breakage in the shed, the piece of yarn on the shed exit side also has to be removed. To this end, the weft clearing device includes a pivotably mounted hollow extraction duct 30 at the exit side of the shed. As indicated, this duct 30 is of curved shape and has an aperture at the free end which is aligned with the weft yarn 15 exiting from the shed in order to draw a broken weft yarn into the duct 30 As indicated, the duct 30 is pivotable in the direction indicated by the double arrow T so as to move between an extended position adjacent to the weft yarn 15 and a raised retracted position above the shed. As indicated, the duct 30 is positioned between the shed and the yarn brake 20.

Means are also provided on the duct in the form of a pivotable hook element 31 for retaining the weft yarn at the aperture of the extraction duct 30. After execution of a pivoting movement, indicated by the arrow U, the hook element 11 serves to retain the broken weft yarn 15 at the aperture of the duct 30.

Pivoting the channel 30 upwards, as indicated by the double arrow T, draws the weft yarn 15 some way out of the shed. After reversal of the pivoting movement, the released piece of weft yarn can be extracted, as indicated by an arrow C in FIG. 5, the hook element 31 having first pivoted back. The yarn can be extracted completely by repeating pivoting of the duct 30 and repeated operation of the hook element 31 and finally by the opening of the projectile clamp.

A clamp or some other gripping element can be provided instead of the pivotable hook element 31. Advantageously, for example, a blowing tube 35 is used, the air flowing in the direction indicated by an arrow B in FIG. 5. At the start of yarn removal, the blowing tube 35 helps to form a loop from the yarn 15 hanging loosely between the shed and the yarn brake 20, which can be supplied reliably to the intake aperture of the duct 30.

If the weft yarn 15 breaks near the shed end, the yarn may be torn out of the shed completely and hurled into the yarn brake 20. For this case, a second blowing nozzle (not shown in FIG. 5) is provided. This nozzle is disposed laterally beside the yarn brake 20 and enables the piece of yarn to be blown out of the yarn brake 20 towards the shed and, therefore, in front of the intake aperture of the extraction duct 30.

The weft clearing device is thus not only capable of clearing broken weft yarns from a loom but also in preparing a fresh weft yarn for picking into a shed. In this respect, the device is particularly useful in multi-weft projectile looms having color changers.

The invention further provides a weft clearing device which is able to clear a broken weft yarn from a projectile loom in a minimum of time and in an efficient manner.

What is claimed is:

1. A method of clearing a weft yarn break in a loom having means for defining a shed of warp yarns, said method comprising the steps of positioning a pivotally mounted hollow yarn guiding member adjacent the shed and in alignment with a weft yarn broken within the shed;

effecting a suction force in the yarn guiding member to draw a loop of the aligned weft yarn into the yarn guiding member; and thereafter pivoting the yarn guiding member in a reciprocating manner transversely relative to the shed to draw the broken weft yarn from the shed while maintaining the suction force in the yarn guiding member.

2. A method as set forth in claim 1 wherein the yarn guiding member is pivoted between a bottom position below the shed and a top position above the shed, said positions being diametrically opposite each other.

3. A method as set forth in claim 1 wherein pivoting of the yarn guiding member effects partial withdrawal of a weft yarn from the shed and the suction force completes withdrawal of a weft yarn from the shed.

4. A method as set forth in claim 1 which further comprises the step of holding the weft yarn within the yarn guiding member from moving out of the yarn guiding member towards said shed.

5. A method as set forth in claim 1 which further comprises the steps of monitoring the tension in a weft yarn in said shed to record the occurrence of a weft yarn break and stopping movement of a reed in the shed for beating up the weft yarn in response to detection of a weft yarn break.

6. A method as set forth in claim 1 which further comprises the step of loosening a beaten-up weft yarn in the shed after breaking thereof and prior to drawing of the broken weft yarn into the yarn guiding member.

7. A device for a loom comprising a pneumatic injector nozzle for conveying a weft yarn therethrough towards a shed of warp yarns; and a pivotally mounted yarn guiding member including a hollow portion, said yarn guiding member being pivotable between a first position aligned with said nozzle for receiving a weft yarn therefrom within said hollow portion and a second position to draw a broken weft yarn from the shed.

8. A device as set forth in claim 7 wherein said yarn guiding member has an aperture for passage of a weft yarn therethrough and a deflecting element disposed adjacent said aperture for deflecting a weft yarn passing thereover during movement of said yarn guiding member from said first position to said second position.

9. A device as set forth in claim 7 which further comprises a pivotally mounted hollow extraction duct at an exit side of the shed having an aperture aligned with a weft yarn exiting the shed for drawing a broken weft yarn into said duct and means on said duct for retaining a weft yarn at said aperture.

10. A device as set forth in claim 9 which further comprises a blowing nozzle for blowing a broken weft yarn aligned with said duc aperture into said aperture.

11. A device as set forth in claim 9 which further comprises a blowing nozzle for blowing a weft yarn from a projectile in a yarn brake on said exit side of the shed towards said duct aperture.

12. A device as set forth in claim 7 further comprising a centering vane between said injector nozzle and said yarn guiding member for guiding a weft yarn from said nozzle into the shed and a hook needle for sliding into hooked engagement with a weft yarn extending between said nozzle and said vane.

13. A weft yarn clearing device for a loom comprising an injector nozzle for conveying a weft yarn therethrough towards a shed of warp yarns;

a pivotally mounted centering vane for pivoting between a first position aligned with said nozzle to guide a weft yarn extending from said nozzle to the shed and a second position out of alignment with said nozzle;

a movably mounted hollow yarn guiding member movable between a central position aligned with said nozzle to receive a weft yarn therefrom, a bottom position to deflect a weft yarn extending from said nozzle about said vane with said vane in said first position thereof, and a top position to draw a broken weft yarn from the shed; and shears for cutting a weft yarn between said nozzle and said vane with said yarn guiding member in said bottom position to form a yarn tip for subsequent picking into the shed.

14. A device as set forth in claim 13 wherein said yarn guiding member has an aperture for passage of a weft yarn therethrough and a deflecting element disposed adjacent said aperture for deflecting a weft yarn passing thereover during movement of said yarn guiding member from said central position to said top position to increase the length of broken weft yarn drawn from the shed with said vane in said first position thereof.

15. A device as set forth in claim 14 which further comprises a reciprocably mounted clamp between said nozzle and said shears for gripping the weft yarn therebetween.

16. A device as set forth in claim 13 which further comprises an extraction duct communicating with said yarn guiding member to withdraw a weft yarn therefrom under a suction force.

17. A device as set forth in claim 13 which further comprises a reciprocably mounted hook needle between said nozzle and said vane for selective disposition over a weft yarn extending therebetween to permit blowing of a loop of weft yarn between said nozzle and said needle into said yarn guiding member for withdrawing a weft yarn having a break upstream of said nozzle with said member in said central position.

18. A device as set forth in claim 17 wherein said hook needle is movable into a retracted position with said vane in said second position thereof to permit conveyance of a fresh weft yarn from said nozzle into said yarn guiding member.

19. A device as set forth in claim 13 which further comprises a pivotally mounted hollow extraction duct at an exit side of the shed having an aperture aligned with a weft yarn exiting the shed for drawing a broken weft yarn into said duct and means on said duct for retaining a weft yarn at said aperture.

20. A device as set forth in claim 19 which further comprises a blowing nozzle for blowing a weft yarn from a projectile in a yarn brake on said exit side of the shed towards said duct aperture.

* * * * *

UNITED STATES PATENT AND TRADEMARK OFFICE

CERTIFICATE OF CORRECTION

PATENT NO. : 5,158,120

DATED : October 27, 1992

INVENTOR(S) : Kaufmann et al.

It is certified that error appears in the above-identified patent and that said Letters Patent is hereby corrected as shown below:

Column 1, line 22, change "to picking" to --to a picking--;

Column 1, line 49, change "With the" to --with the--;

Column 2, line 60, change "Weft" to --weft--;

Column 4, line 53, change "13," to --13'--;

Column 4, line 67, change "4," to --4'--;

Column 6, line 7, change "tion After" to --tion. After--;

Column 6, line 40, change "30 As" to --30. As--;

Column 7, line 61, change "apivotally" to --a pivotally--;

Column 8, line 13, change "said duc" to --said duct--.

Signed and Sealed this

Twenty-second Day of March, 1994

*Attest:*

Bruce Lehman

BRUCE LEHMAN

*Attesting Officer*

*Commissioner of Patents and Trademarks*